US011905779B2

(12) United States Patent
Infante

(10) Patent No.: US 11,905,779 B2
(45) Date of Patent: Feb. 20, 2024

(54) SYSTEMS AND METHODS FOR RUNNING TUBULARS

(71) Applicant: Tubular Running & Rental Services LLC, Fulshear, TX (US)

(72) Inventor: Jairo Gutierrez Infante, Bogota (CO)

(73) Assignee: Tubular Technology Tools LLC, Fulshear, TX (US)

( * ) Notice: Subject to any disclaimer, the term of this patent is extended or adjusted under 35 U.S.C. 154(b) by 0 days.

(21) Appl. No.: 17/684,865

(22) Filed: Mar. 2, 2022

(65) Prior Publication Data

US 2022/0243548 A1 Aug. 4, 2022

Related U.S. Application Data

(63) Continuation-in-part of application No. 17/639,466, filed as application No. PCT/IB2020/060729 on Nov. 14, 2020.

(60) Provisional application No. 62/940,756, filed on Nov. 26, 2019.

(51) Int. Cl.

| | |
|---|---|
| ***E21B 31/20*** | (2006.01) |
| ***E21B 19/07*** | (2006.01) |
| ***E21B 19/16*** | (2006.01) |

(52) U.S. Cl.

CPC ..... *E21B 31/20* (2013.01); *E21B 19/07* (2013.01); *E21B 19/16* (2013.01)

(58) Field of Classification Search

CPC ..... E21B 19/07; E21B 19/16; E21B 31/20
See application file for complete search history.

(56) References Cited

U.S. PATENT DOCUMENTS

| | | | | |
|---|---|---|---|---|
| 881,496 | A | 3/1908 | Seaman | |
| 1,441,583 | A | 1/1923 | Humason | |
| 1,843,537 | A | 2/1932 | Bickerstaff | |
| 2,184,681 | A | 12/1939 | Osmun | |
| 2,191,000 | A * | 2/1940 | Idris | E21B 31/20 294/102.1 |

(Continued)

FOREIGN PATENT DOCUMENTS

| | | | | |
|---|---|---|---|---|
| CA | 3150841 A1 * | 3/2021 | ..... | E21B 19/166 |
| WO | WO-2022177444 A1 * | 8/2022 | ..... | E21B 23/01 |

OTHER PUBLICATIONS

Written Opinion of the International Searching Authority, International Application No. PCT/IB2020/060729, dated Feb. 23, 2021.

(Continued)

*Primary Examiner* — Jennifer H Gay
(74) *Attorney, Agent, or Firm* — Victor H. Segura

(57) ABSTRACT

A tubular running tool equipped with a mandrel having an elongated body with a longitudinal axis and configured for suspension above a wellbore. A plurality of slips are disposed on the mandrel. Each slip is configured to receive and retain a swappable insert. Each swappable insert is configured with a gripping portion on a surface thereof. A sensor is configured to detect when a tubular is in a determined position to permit actuation of the mandrel to urge the slips radially outward such that the slips remain parallel to the longitudinal axis of the mandrel and the inserts are correspondingly urged radially outward. A method and system using the tool for running a tubular and providing a makeup torque.

18 Claims, 8 Drawing Sheets

(56) References Cited

U.S. PATENT DOCUMENTS

| | | | | |
|---|---|---|---|---|
| 2,769,655 | A | 11/1956 | Holmes | |
| 6,309,002 | B1 | 10/2001 | Frank's | |
| 6,431,626 | B1 | 8/2002 | Frank's | |
| 6,679,333 | B2 | 1/2004 | Canrig | |
| 6,732,822 | B2 | 5/2004 | Frank's | |
| 6,742,584 | B1 | 6/2004 | Nabors | |
| 6,920,926 | B2 | 7/2005 | Canrig | |
| 7,140,443 | B2 | 11/2006 | Nabors | |
| 7,377,324 | B2 | 5/2008 | Nabors | |
| 7,445,050 | B2 | 11/2008 | Nabors | |
| 7,770,654 | B2 | 8/2010 | Nabors | |
| 7,874,352 | B2 * | 1/2011 | Odell, II | E21B 19/16 166/77.51 |
| 8,042,626 | B2 * | 10/2011 | Slack | E21B 3/022 175/423 |
| 8,240,371 | B2 | 8/2012 | Nabors | |
| 8,893,772 | B2 | 11/2014 | Henderson | |
| 9,057,234 | B2 | 6/2015 | Nabors | |
| 9,206,657 | B2 * | 12/2015 | Küttel | E21B 41/0021 |
| 10,697,257 | B2 * | 6/2020 | Dewald | E21B 19/16 |
| 10,954,736 | B2 * | 3/2021 | Schmidt | E21B 31/20 |
| 2001/0042625 | A1 | 11/2001 | Appleton | |
| 2002/0170720 | A1 * | 11/2002 | Haugen | E21B 19/00 166/380 |
| 2007/0131416 | A1 * | 6/2007 | Odell, II | E21B 19/165 166/250.1 |
| 2008/0264648 | A1 * | 10/2008 | Pietras | E21B 19/16 166/85.1 |
| 2009/0272543 | A1 * | 11/2009 | Bouligny | E21B 19/16 414/800 |
| 2011/0048737 | A1 * | 3/2011 | Schneider | E21B 41/0021 166/380 |
| 2011/0132594 | A1 * | 6/2011 | Slack | E21B 19/16 166/77.51 |
| 2012/0043071 | A1 * | 2/2012 | Matherne, Jr. | E21B 19/10 166/77.53 |
| 2013/0118760 | A1 * | 5/2013 | Kuttel | E21B 19/06 166/85.1 |
| 2014/0097960 | A1 * | 4/2014 | Guidry | E21B 41/0021 340/686.2 |
| 2015/0027732 | A1 * | 1/2015 | Wood | E21B 21/02 166/380 |
| 2019/0106977 | A1 * | 4/2019 | Amezaga | E21B 47/135 |
| 2019/0257161 | A1 * | 8/2019 | Dewald | E21B 19/07 |
| 2019/0284894 | A1 * | 9/2019 | Schmidt | E21B 23/01 |
| 2020/0378198 | A1 * | 12/2020 | Hill | E21B 19/16 |
| 2021/0071515 | A1 * | 3/2021 | Sonnier | E21B 23/00 |
| 2022/0243548 | A1 * | 8/2022 | Infante | E21B 31/20 |
| 2022/0333449 | A1 * | 10/2022 | Infante | E21B 31/20 |

OTHER PUBLICATIONS

International Search Report, International Application No. PCT/IB2020/060729, dated Feb. 23, 2021.

* cited by examiner

SYSTEMS AND METHODS FOR RUNNING TUBULARS

CROSS-REFERENCE TO RELATED APPLICATIONS

Continuation-in-Part of U.S. patent application Ser. No. 17/639,466 filed Mar. 1, 2022, which is a Continuation of International Application No. PCT/IB2020/060729 filed Nov. 14, 2020, which claims priority from U.S. Provisional Application No. 62/940,756 filed on Nov. 26, 2019. All the foregoing applications are incorporated herein by reference in their entirety.

BACKGROUND

The present disclosure relates generally to methods and apparatus for manipulating tubulars, and more particularly, to techniques for running (e.g., hoisting, moving, and lowering) oilfield tubulars for disposal in a wellbore.

The drilling and completion of subsurface wells involves assembling drill strings and casing strings, each of which entail multiple elongated, heavy tubular segments. A drill string consists of individual sections of pipe which are threadedly engaged together as the string assembly is lowered into a wellbore. Typically, the casing string is provided around the drill string to line the wellbore after drilling the hole, to ensure the integrity of the wellbore. The casing string also consists of multiple pipe segments threadedly coupled together during disposal into the wellbore.

Conventional techniques for assembling drill strings and casing strings entail the use of tools coupled to top drive assemblies. Such tools include manipulators designed to engage a pipe segment and hoist the segment up into a position for engagement to another pipe segment so the tubular assembly can be disposed into a wellbore. While such conventional tools facilitate the assembly of drill pipe and casing strings, such tools suffer from shortcomings. One such shortcoming is that these tools are generally designed for use with pipe segments of a specific internal/external diameter. When different diameter tubular segments are used (as is often the case in well operations), the running tool requires replacement with another tool designed to handle the particular diameter of the tubular in use. This results in inefficiencies producing time delays, added costs, greater risk of personnel injury, and equipment logistic complexity.

Thus, a need remains for improved techniques to efficiently and effectively manipulate or run tubulars.

SUMMARY

According to an aspect of the invention, a tubular running tool includes a mandrel having an elongated body with a longitudinal axis and configured for suspension above a wellbore. The mandrel has a plurality of stepped ramps on a surface thereof, and a plurality of slips are disposed on the mandrel. Each slip has a plurality of stepped ramps configured for complementary engagement with the plurality of stepped ramps of the mandrel. Each slip is configured to receive and retain a swappable insert having a gripping portion on a surface thereof, wherein the mandrel is configured for actuation to urge the slips radially outward such that the slips remain parallel to the longitudinal axis of the mandrel and the swappable inserts disposed on the slips are correspondingly urged radially outward. A sensor is configured to detect when a tubular is in a determined position to permit actuation of the mandrel to urge the slips radially outward to engage the tubular with the swappable inserts.

According to another aspect of the invention, a method for running a tubular includes suspending a mandrel above a wellbore, the mandrel having an elongated body with a longitudinal axis and a plurality of stepped ramps on a surface thereof. A plurality of slips are disposed on the mandrel, each slip having a plurality of stepped ramps configured for complementary engagement with the plurality of stepped ramps of the mandrel, and each slip configured to receive and retain a swappable insert having a gripping portion on a surface thereof. A section of the mandrel is disposed into an open end of a tubular. A sensor is used to detect when the tubular is in a determined position to permit actuation of the mandrel. The mandrel is actuated to urge the slips radially outward such that slips remain parallel to the longitudinal axis of the mandrel and the swappable inserts disposed on the slips are correspondingly urged radially outward to engage the inner surface of the tubular. The tubular is suspended and moved with the mandrel to a desired location. At the desired location the mandrel is actuated to retract the slips to disengage the swappable inserts from the inner surface of the tubular to release the tubular.

BRIEF DESCRIPTION OF THE DRAWINGS

The following figures form part of the present specification and are included to further demonstrate certain aspects of the present disclosure and should not be used to limit or define the claimed subject matter. The claimed subject matter may be better understood by reference to one or more of these drawings in combination with the description of embodiments presented herein. Consequently, a more complete understanding of the present embodiments and further features and advantages thereof may be acquired by referring to the following description taken in conjunction with the accompanying drawings, in which like reference numerals may identify like elements, wherein:

DETAILED DESCRIPTION

The foregoing description of the figures is provided for the convenience of the reader. It should be understood, however, that the embodiments are not limited to the precise arrangements and configurations shown in the figures. Also, the figures are not necessarily drawn to scale, and certain features may be shown exaggerated in scale or in generalized or schematic form, in the interest of clarity and conciseness.

Figure 1:
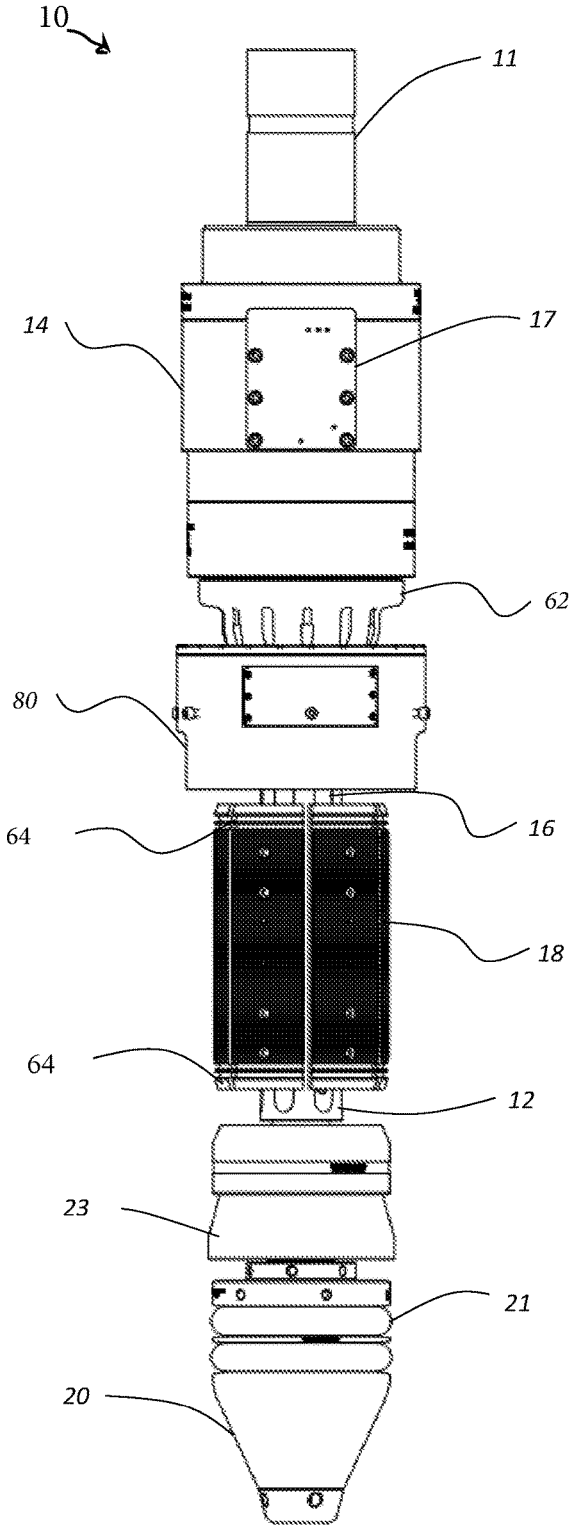
FIG. 1 shows a schematic of a tubular running tool according to an example of the present disclosure.

FIG. 1 shows a tubular running tool 10 embodiment of this disclosure. The tool 10 includes a mandrel 12, an actuator 14, a number of slips 16 disposed on the mandrel, a number of swappable inserts 18 mounted on the slips, and a spear head 20 disposed at the distal end of the mandrel. The spear head 20 is elongated to support a series of O-rings 21 that assist to guide and center the mandrel 12 when the mandrel is inserted within a tubular, as described herein. Some spear head 20 embodiments may also be configured with a packer cup 23 at an upper end to provide sealing for the mandrel 12 when inserted within a tubular. The packer cup 23 also prevents fluids (e.g., drilling mud) from splashing out when fluids are pumped through the mandrel and into a connected tubular (further described herein). The packer may be formed of suitable rubber compounds as known in the art. As used herein, the term "swappable" means readily and easily removeable and replaceable as a single part or component.

Figure 2:
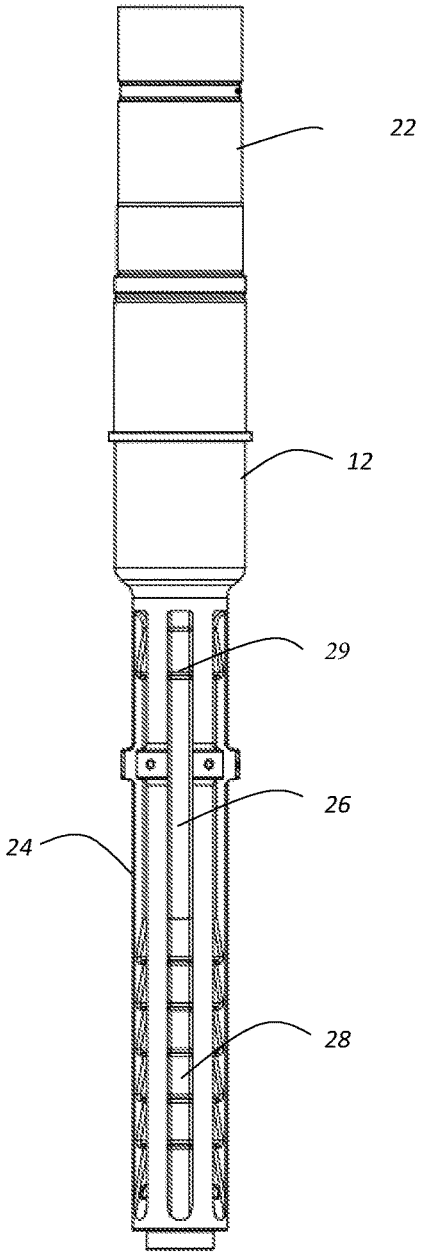
FIG. 2 shows a schematic of a mandrel according to an example of the present disclosure.

FIG. 2 shows an embodiment of a bare mandrel 12, without components disposed thereon. In one embodiment, the mandrel 12 is formed as a one-piece metallic (e.g. steel) tubular configured with an upper end 22 having a larger diameter compared to a stem 24 portion having a smaller diameter at an opposing end. As shown in FIG. 2, the stem 24 portion is configured with channels 26 running along the longitudinal axis of the mandrel 12. Mandrel 12 embodiments may be configured with one or more channels 26 formed therein. When multiple channels 26 are formed, they can be evenly spaced around the circumference of the tubular stem 24 portion and the number of channels may vary depending on the diameter of the mandrel 12 implementation. As shown in FIG. 2, each channel 26 is uniformly formed along a section of the stem 24 portion. Each channel 26 includes a plurality of stepped ramps 28 formed on the exterior mandrel 12 surface near the end or tip of the stem 24 portion. Each channel 26 also includes a superior ramp 29 formed on the exterior surface near the opposite end of the channel.

Figure 3A:
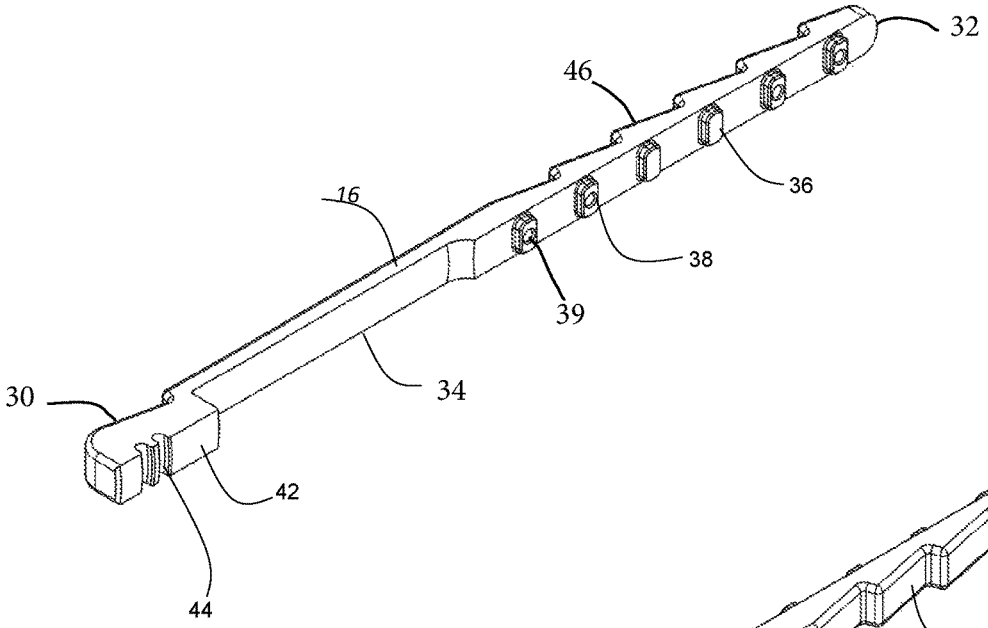
FIG. 3A shows a perspective view of a tool slip according to an example of the present disclosure.

FIG. 3A shows a slip 16 embodiment of this disclosure. The slip 16 is formed as an elongated blade structure having an upper end 30, a lower end 32, and a stem 34 portion in between. FIG. 3A shows the surface of the slip 16 which faces outward when the slip is disposed within a channel 26 on the mandrel 12. The lower end 32 of the slip 16 includes one or more raised alignment tabs 36 and one or more raised retaining tabs 38. The alignment tab(s) 36 and retaining tab(s) 38 may be formed in any suitable shape (e.g., round, oval, square, etc.), with each retaining tab 38 having a threaded hole 39 formed therein to receive a fastening bolt 40 (see FIG. 8A) to hold an insert 18 in place. Each narrow slip 16 is configured to fit and reside within a channel 26 on the mandrel 12. The upper end 30 of the slip 16 has an elevation 42 that provides a retention shoulder for the slip at the upper end (further described below with respect to FIGS. 8A, 8B, and 10). The elevation 42 also has one or more grooves 44 formed thereon to receive a spring 60 (see FIG. 8A) to provide a constricting force against the slip 16 as further described below. The opposing surface or backside of the slip 16 has a plurality of ramps 46 formed thereon and configured for complementary engagement with the plurality of ramps 28, 29 formed on the exterior of the mandrel 12 body (further described below).

Figure 3B:
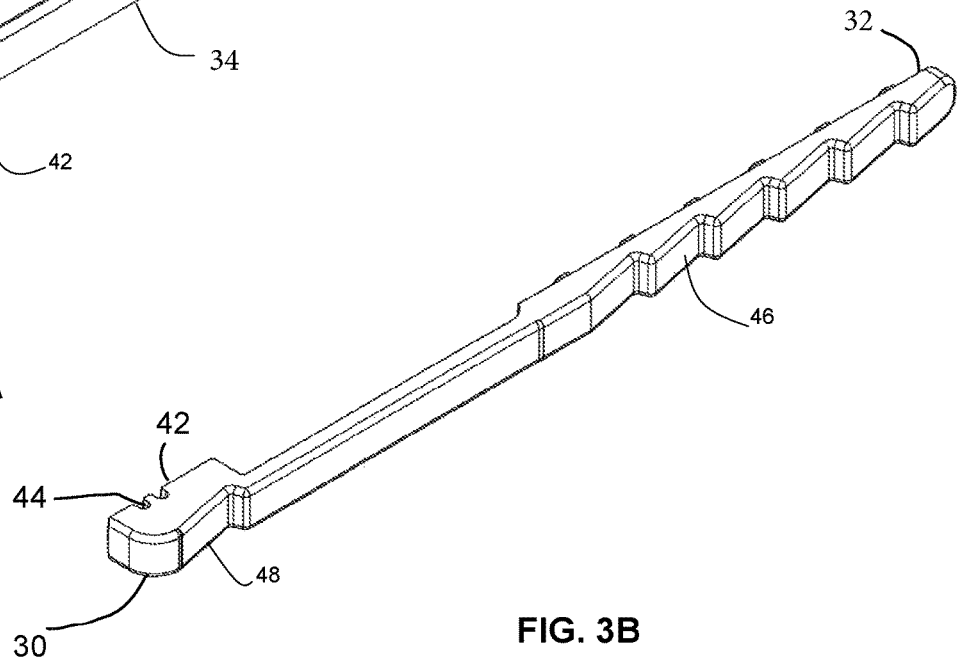
FIG. 3B shows a perspective view of the opposite side of the tool slip of FIG. 3A.

FIG. 3B shows the slip 16 embodiment of FIG. 3A from the backside or opposite surface that abuts against the mandrel 12 surface when the slip is disposed in the mandrel channel 26. A plurality of stepped ramps 46 are formed near the lower end 32 of the slip 16. These stepped ramps 46 are configured for complementary engagement with the stepped ramps 28 formed on the mandrel 12 surface. The slip 16 also includes a ramp 48 formed near the upper end 30 of the slip on the opposite side of elevation 42. This ramp 48 is configured for complementary engagement with the superior ramp 29 formed on the mandrel 12 surface, as further described below.

Figure 4A:
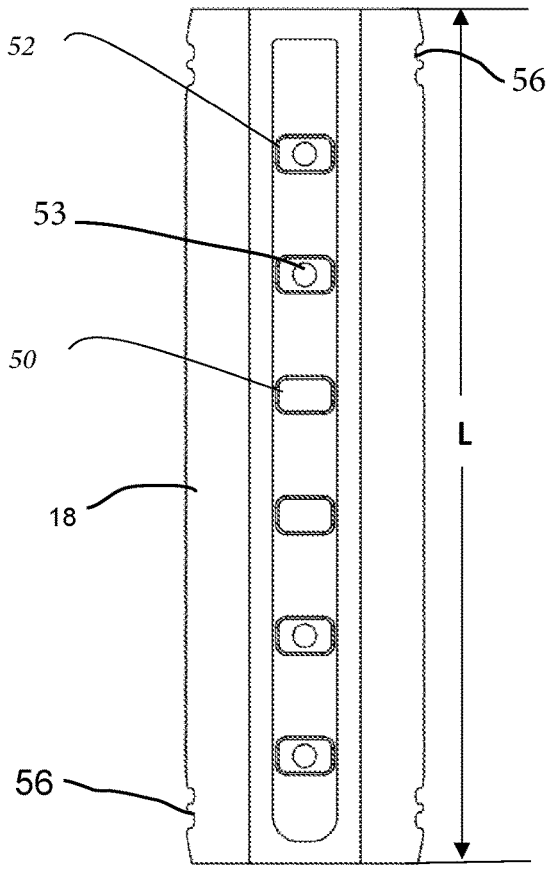
FIG. 4A shows a schematic of a swappable insert according to an example of the present disclosure.

FIG. 4A shows a view of one side of a swappable insert 18 embodiment of this disclosure. FIG. 4A shows the side of the insert 18 configured for placement on the slip 16 surface that faces outward when the slip is disposed within a channel 26 on the mandrel 12 (see FIG. 3A). The insert 18 is formed as an elongated structure having a selected length L. The insert 18 includes one or more alignment tab receptacles 50 to receive the one or more raised alignment tabs 36 on the slip 16, and one or more retaining tab receptacles 52 to receive the one or more raised retaining tabs 38 on the slip 16 (see FIG. 3A). The receptacles 50, 52 are formed as voids to match the shape (e.g., round, oval, square, etc.) of the respective tabs 36, 38 on the slip 16. Each retaining tab receptacle 52 is also configured with a hole 53 formed through the body of the insert 18 to permit passage of a fastening bolt 40 (see FIG. 8A).

Figure 4B:
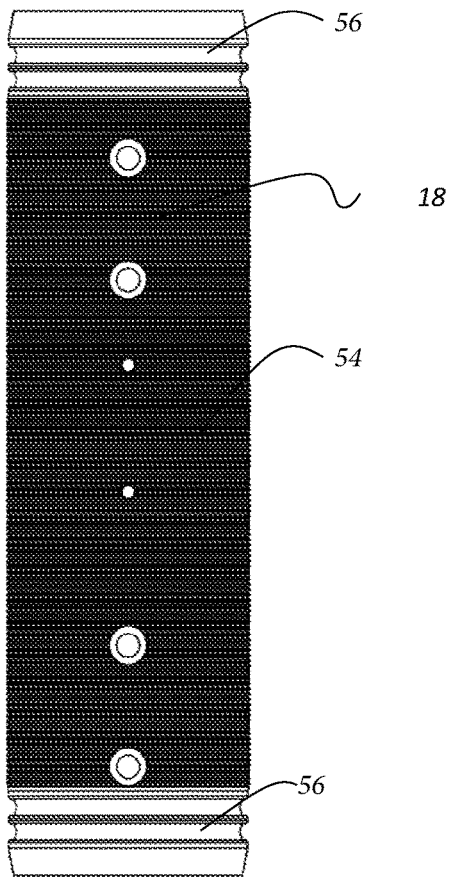
FIG. 4B shows a schematic of the opposite side of the swappable insert of FIG. 4A.

FIG. 4B shows the opposite side of the insert 18 of FIG. 4A. This side forms the outer surface of the insert 18 and is configured with a gripping portion 54 to provide an abrasive or non-smooth surface. The gripping portion 54 may be formed via conventional techniques as known in the art (e.g., knurled surface, layer deposition, chemical treatment, shot peening, etc.). The swappable insert 18 is also configured with one or more grooves 56 formed near each end of the insert. The grooves 56 are formed running horizontally from one side to the other along the surface of the insert 18. Each groove 56 is configured to receive a spring 64 (see FIG. 8A) to provide a constricting force against the swappable inserts 18 as further described below.

Figure 5:
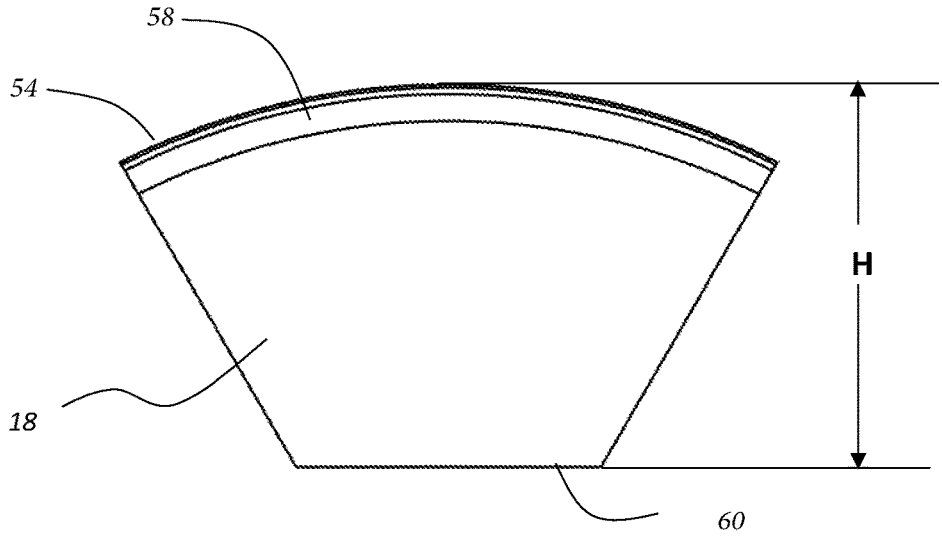
FIG. 5 shows an end view of an insert according to an example of the present disclosure.

FIG. 5 shows an end view of an insert 18 embodiment. The insert 18 is formed with a circular sector profile 58 having a selected height H as measured from a generally planar base 60 to the gripping portion 54 forming the outer surface (for example, but not to be limited to, between 1.316-3.187 inches (3.34-8.09 cm)). Conventional tubulars used in the oil and gas industry vary in internal diameter (ID) in relation to the weight of the tubular. Some operations require heavier weight pipe compared to other applications. The heavier the pipe, generally the thicker the wall of the pipe, and thus the variance in the ID of the different tubulars. It is also common in the industry to mix tubulars having different IDs in a single string during wellbore operations. The disclosed tools 10 allow one to quickly and easily swap inserts 18 in order to handle tubulars having different IDs without disruption to operations. By selecting a swappable insert 18 of a set height H, the overall mandrel 12 diameter can be easily altered and set as desired depending on the ID of the particular tubular to be run. The fastening bolts 40 (see FIG. 8A) allow for convenient and rapid swapping of inserts 18 having different heights H to address the particular operation.

Figure 6:
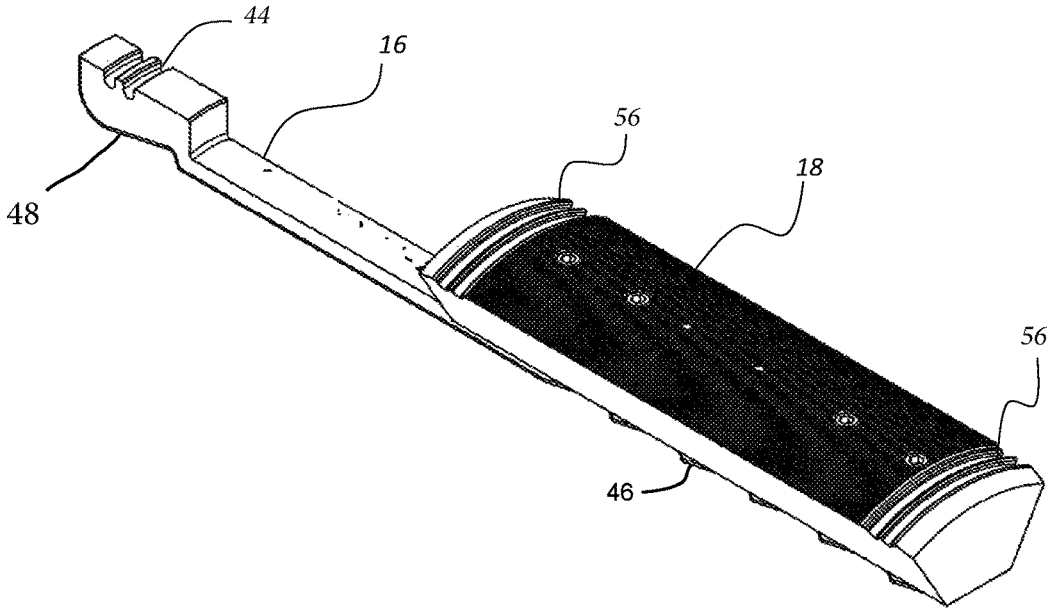
FIG. 6 shows a perspective view of a tool slip with an insert according to an example of the present disclosure.

FIG. 6 shows an oblique view of a slip 16 having a swappable insert 18 mounted thereon. By swapping out the inserts 18 on the slips 16 using inserts of a selected height H (as described with respect to FIG. 5), the overall diameter of the tool assembly can be set as desired so that the stem 24 portion of the mandrel 12 can be inserted into tubulars of various inside diameters.

Figure 7:
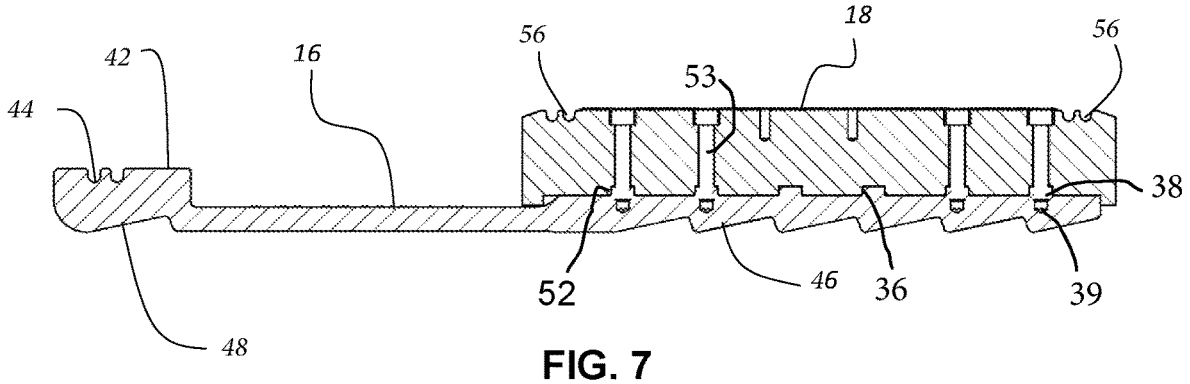
FIG. 7 shows a side view of a tool slip with an insert according to an example of the present disclosure.

FIG. 7 shows a cross-section of a swappable insert 18 mounted on a slip 16 embodiment of this disclosure. The insert 18 is mounted on the slip 16 such that the one or more raised alignment tabs 36 on the slip 16 are received by the respective one or more alignment tab receptacles 50 on the insert, and the one or more raised retaining tabs 38 on the slip 16 are received by the respective one or more retaining tab receptacles 52 on the insert 18. The inserts 18 can be interchanged on the slips 16 without having to remove the individual slips from the mandrel 12. In this manner, the tool 10 embodiments of this disclosure allow one to quickly and efficiently change the diameter of the tool mandrel 12 for use with tubulars of various IDs. For example, removal and replacement of the swappable inserts 18 can be easily and rapidly performed while the tool 10 remains suspended over a wellbore (see FIG. 12).

Figure 8A:
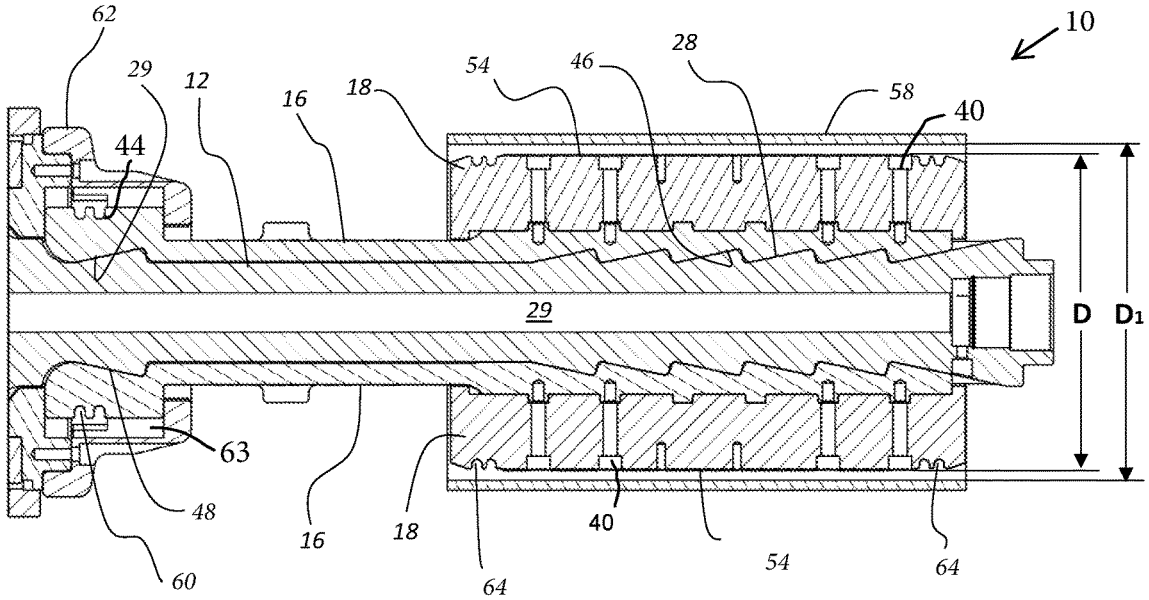
FIG. 8A shows a cross section of a mandrel in a neutral position within a tubular according to an example of the present disclosure.

FIG. 8A shows a cross-section schematic of a tool 10 mandrel 12 embodiment of this disclosure configured with a pair of slips 16 and inserts 18 disposed thereon. The end of the assembly is shown disposed in an open end of a tubular 58 having an inside diameter of $D_1$. The assembly is inserted within the open end of the tubular 58 with the stepped ramps 46 of the slip 16 in complementary engagement with the stepped ramps 28 of the mandrel 12 at one end of the assembly. At the other end of the assembly, the superior ramp 29 of the mandrel 12 is in complementary engagement with the ramp 48 of the slip 16. In this mode, the tool 10 is in the neutral position. In the neutral position, the lands of the ramps 28, 46 and 29, 48 are mated in a low position such that the slips 16 lie close to the mandrel 12 body. In the neutral position, the overall tool assembly diameter is at a minimum D, which allows the tool to be disposed into the end of a tubular 58 of inner diameter $D_1$ (where $D_1$>D). FIG. 8A shows a cross section of a spring 60 situated within the groove 44 on the slip 16. The spring 60 surrounds the entire mandrel 12, providing a constricting force to maintain the ramp 48 of the slip 16 in contact with the superior ramp 29 of the mandrel 12. Any suitable conventional spring 60 may be used (e.g., metallic toroidal spring).

The tool 10 is configured with a connection plate 62 which surrounds and prevents the slips 16 from detachment from the assembly at the upper ends 30 and links the slip ends with the actuator 14 (see FIG. 1). The connection plate 62 provides an annular space 63 which permits the slips 16 to expand radially outward from the neutral position to an extended position when the actuator 14 is actuated to move the mandrel 12, which in turn moves the ramps 28, 29 as described with respect to FIG. 8B.

Figure 8B:
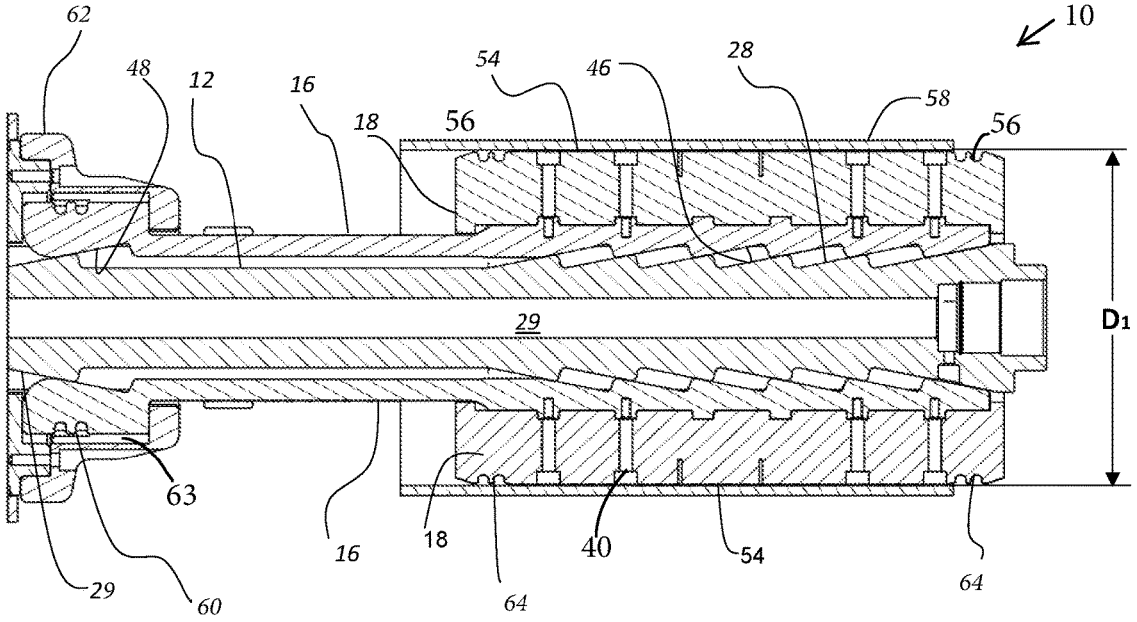
FIG. 8B shows a schematic of the mandrel of FIG. 8A in an extended position within the tubular according to an example of the present disclosure.

FIG. 8B shows the tool 10 with the mandrel 12 moved axially (to the left in FIG. 8B), while the slips 16 remain stationary in the axial direction. As the mandrel 12 moves axially (e.g., up or towards the upper end of the tool 10), the stepped ramps 28 and the superior ramp 29 on the mandrel 12 respectively slide against the ramps 46, 48 of the slips 16. As depicted in FIG. 8B, as the peaks of the ramps 28, 29 on the mandrel 12 slide axially against the ramps 46, 48 on the slip 16, the mandrel ramp peaks urge the slip ramps radially outwards. By configuring the mandrel 12 and slips 16 with the ramps 28, 29, 46, 48 as disclosed herein, the slips 16 remain parallel to the longitudinal axis of the mandrel as the slips are actuated to expand radially outward, as depicted in FIG. 8B. This configuration provides an advantage as it reduces component fatigue compared to configurations with pivoting junctions. As the slips 16 are actuated to expand radially outward, the swappable insert 18 on each slip is correspondingly urged radially outward such that the gripping portion 40 on the outer surface of the insert remains parallel to the longitudinal axis of the mandrel as it makes contact with and secures against the inner diameter surface of the tubular 58. Once the tool 10 end is disposed in the open end of a tubular 58 and actuated to the extended position as described herein, the tubular is engaged and can be manipulated (e.g., raised, suspended, transported, lowered, rotated and/or torqued in connection with another tubular, etc.) by movement of the assembly as desired.

FIG. 8B shows a cross section of a pair of springs 64 disposed on the tool 10, with one spring placed over each end of the insert 18 within the grooves 56 formed on the outer circumference of the insert (see FIG. 4B). Each spring 64 surrounds the entire mandrel-insert assembly, providing a constricting force upon the inserts 18 and thereby maintaining the slips 16 within the mandrel 12 channels 28 when in the neutral position. Any suitable conventional springs 64 may be used (e.g., metallic toroidal springs).

As disclosed herein, the mandrel 12 is moved axially on the tool 10 via the actuator 14 (see FIG. 1). In some embodiments, the actuator 14 comprises a hydraulic mechanism with an internal valve 17 that can be activated to move the mandrel 12 in one axial direction or the other via hydraulic fluid pressure as known in the art. For example, the actuator 14 may be implemented with a conventional hydraulic pilot valve 17 allowing flow direction to be switched to actuate movement of the mandrel 12 as desired. As depicted in FIG. 8B, one embodiment of the tool 10 is configured such that when the actuator 14 moves the mandrel 12 upward or toward the upper end of the tool (to the left in FIG. 8B), the slips 16 are urged radially outward into the extended position as described above, and when the mandrel moves downward or toward the lower end of the tool, the slips retract into the channels 26 on the mandrel and into the neutral position. In some embodiments, the actuator 14 may comprise an electromagnet configured with a conventional solenoid/spring mechanism coupled to the mandrel 12 to provide the axial motion. In other embodiments, the actuator 14 may comprise a conventional pneumatic piston-type mechanism coupled to the mandrel 12 to provide the axial motion.

Figure 9:
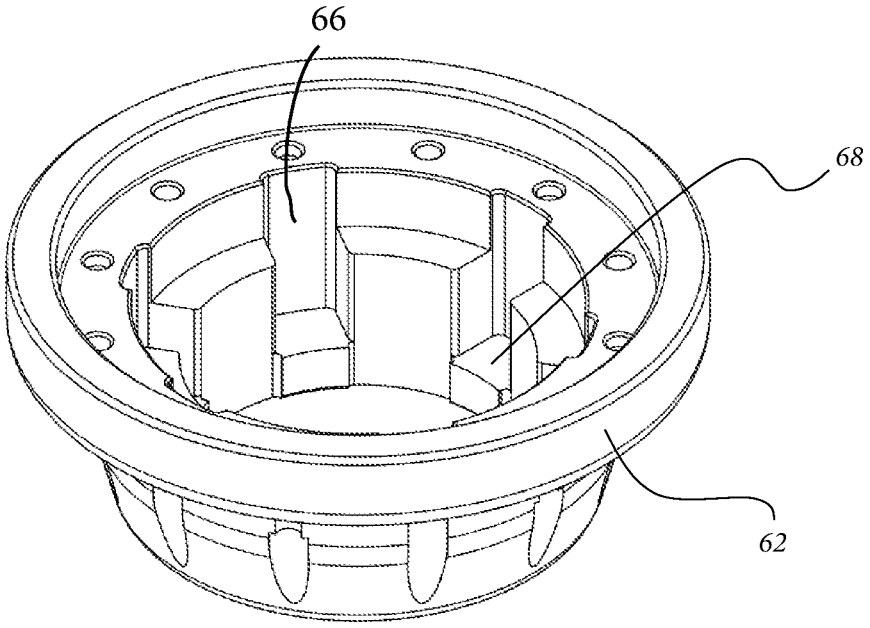
FIG. 9 shows a schematic of a connection plate according to an example of the present disclosure.

FIG. 9 shows an embodiment of a connection plate 62. This embodiment is configured as an annular ring structure having internal channels 66 formed thereon to accept and house the upper ends 30 of the slips 16. When disposed on the tool 10, the connection plate 62 surrounds and prevents the slips 16 from detachment from the assembly at the slip upper ends 30 (See FIG. 8A). Each channel 66 includes a lower ledge 68 to guide the elevation 42 formed on the end of the slip 16, as shown in FIG. 10.

Figure 10:
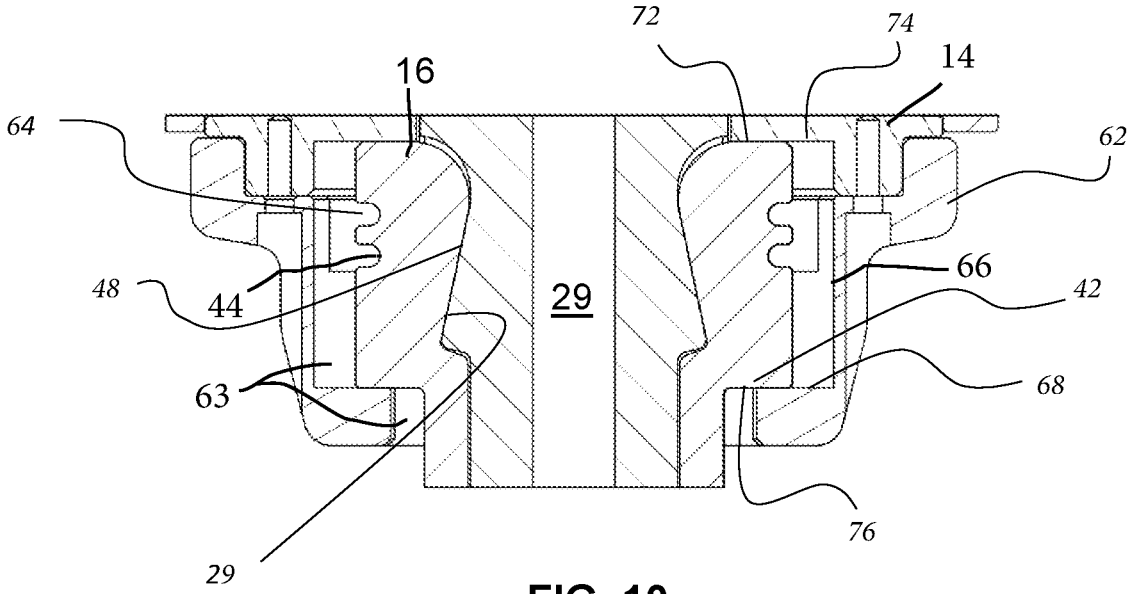
FIG. 10 shows a cross section of a mandrel and connection plate assembly according to an example of the present disclosure.

FIG. 10 shows a cross section of the tool 10 assembly at the connection plate 62. The upper end of the connection plate 62 is coupled to the actuator 14 (see FIG. 1). The internal channels 66 on the connection plate 62 provide the annular space 63 which permits the slips 16 to expand radially outward from the neutral position to the extended position in a parallel motion as disclosed herein. The upper ends 30 of the slips 16 are configured with a planar face 72 that abuts against a lower surface 74 of the actuator 14. The opposite end of the elevation 42 is configured with a planar face 76 that abuts against the lower ledge 68 of the connection plate 62.

Figure 11A:
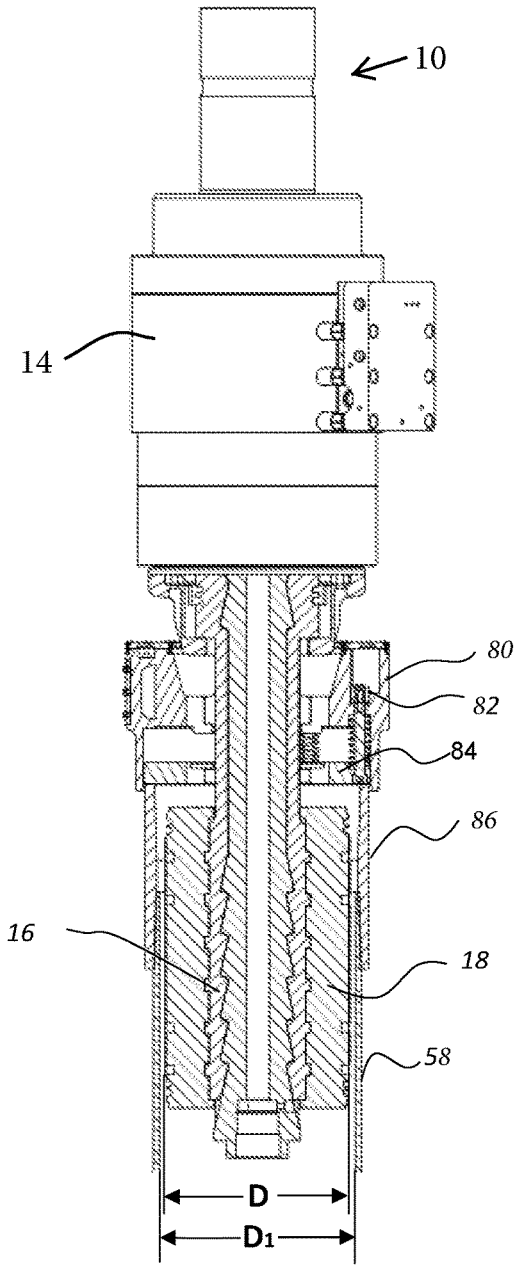
FIG. 11A shows a schematic of a tubular running tool equipped with a sensor system according to an example of the present disclosure.

FIG. 11A shows a cross section of another tool 10 embodiment of this disclosure. In some embodiments, a coupling position sensor housing 80 is disposed on the tool 10. The housing 80 includes one or more sensors 82 linked to a guide plate 84. FIG. 11A shows the guide plate 84 in a neutral position, wherein the sensor(s) 82 is not activated and in turn the actuator 14 is not actuated to displace the mandrel 12 to extend the slips 16 and therefore the inserts 18. The sensor(s) 82 provides a safety measure to ensure the inserts 18 are actuated as described herein from the neutral position to the extended position only when the tubular 58 is in the proper position such that maximum engagement of the gripping portion 54 of the inserts with the tubular's internal wall surface is achieved.

Figure 11B:
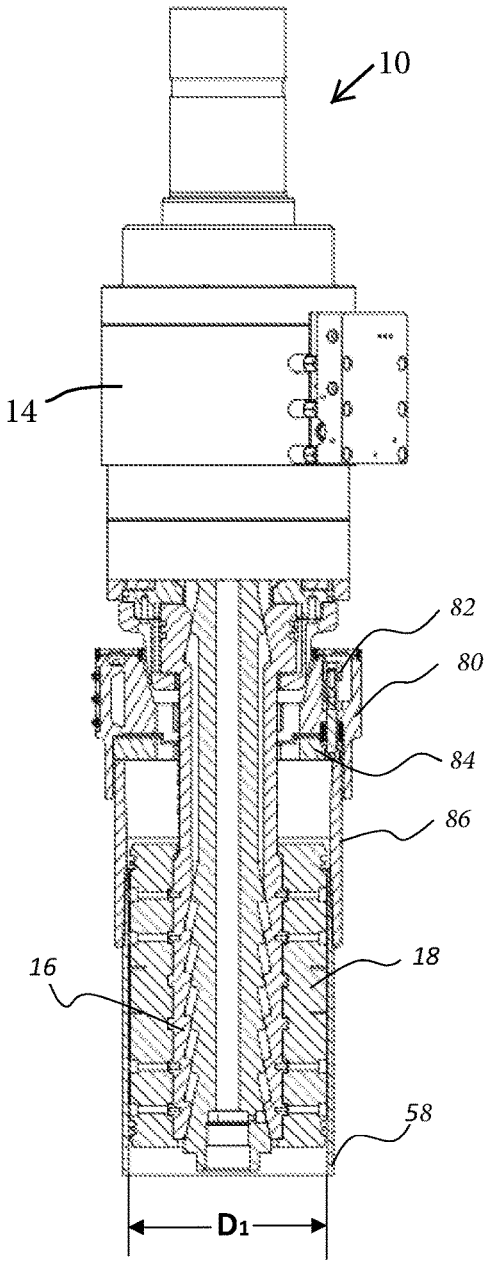
FIG. 11B shows a schematic of the tubular running tool of FIG. 11A with the sensor system in an activated state according to an example of the present disclosure.

FIG. 11A shows the tool 10 with the insert 18 assembly disposed within the open end of a tubular 58. The tool 10 is in the neutral position, with the slips 16 and therefore the inserts 18 in the fully retracted position. As the tool 10 is lowered into the tubular's 58 open end or the tubular is raised toward the tool, a coupling 86 disposed adjacent to the guide plate 84 encircles the outer surface of the tubular. As the insert 18 assembly traverses into the tubular 58, the coupling 86 moves from an initial position (see FIG. 11A) to a contact position until the coupling pushes the guide plate 84 upward, as shown in FIG. 11B. When the insert 18 assembly is positioned within the tubular 58 such that the full length of the inserts is disposed in the tubular, the guide plate 84 reaches a seated position, which in turn triggers and actuates the sensor(s) 82. Upon actuation, the sensor(s) 82 sends a signal to the actuator 14, permitting actuation of the mandrel 12 to extend the slips 16 for maximum engagement of the insert 18 gripping portions 54 with the tubular 58 inner surface. In this manner, the tubular 58 is securely engaged and can be manipulated (e.g., raised, suspended, transported, lowered, rotated and/or torqued in connection with another tubular, etc.) by movement of the assembly as desired. Any conventional sensors 82 may be used with implementations of the present invention as known in the art (e.g., a battery powered microswitch, etc.). Embodiments may be implemented with the sensor(s) 82 hardwired with the actuator 14 or configured for wireless signal transmission as known in the art.

Figure 12:
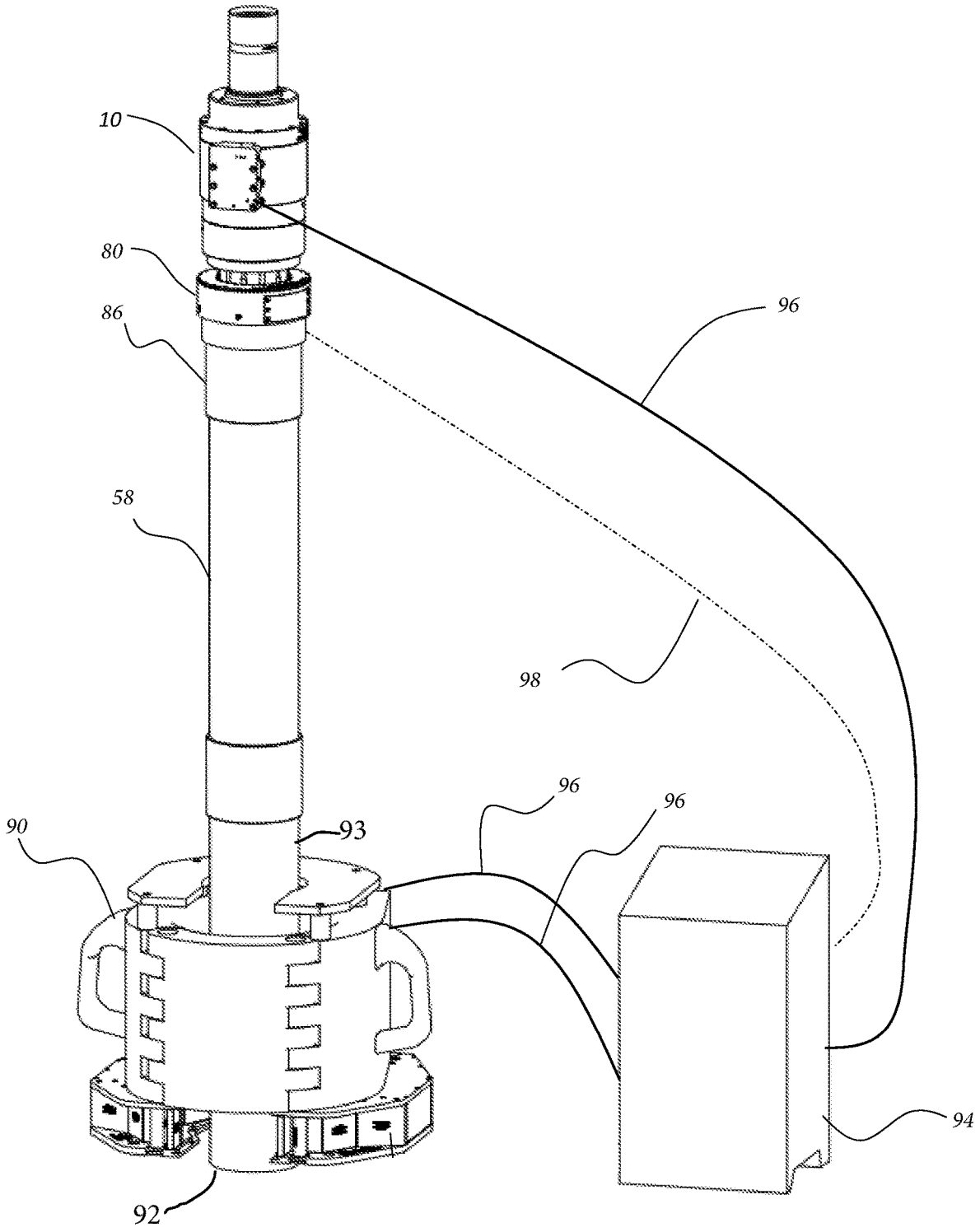
FIG. 12 shows a schematic of a configuration for engaging a tubular at a well site using a tubular running tool and a spider unit according to examples of the present disclosure.

FIG. 12 shows another tool 10 embodiment of this disclosure further implemented with a conventional spider unit 90 (e.g., conventional casing spider unit) arranged over a wellbore 92 at a well site. A tool 10 of this disclosure is positioned above a string 93 of coupled tubulars 58, with the insert 18 assembly disposed within the open end of the top tubular in the string. The tool 10 is in the extended mode as described herein, with the inserts 18 engaging the inner surface of the top tubular 58. The spider unit 90 is positioned above the wellbore 92 and used to support the weight of the string 93 in the wellbore while the tool 10 is used to add or remove adjoining tubular 58 segments. A control module 94 is also linked with the tool 10 and the spider unit 90. The control module 94 is configured with conventional conduits 72 (e.g. hoses, wiring harnesses) linked to the tool 10 and the spider unit 90 to provide fluids (e.g., hydraulic fluid, drilling mud), air pressure, electrical power, and/or signal communications under control of an operator or automated computer system.

In operation, when the top tubular 58 in the string 93 is in complete engagement with the tool 10 insert 18 assembly, the guide plate 84 in the coupling position sensor housing 80 is in the seated position, as described with respect to FIG. 11B. In this seated position, the sensor(s) 82 is actuated to signal the actuator 14 to permit extension of the inserts 18 as described. However, in the event the inserts 18 lose engagement with the inner surface of the tubular 58 and the tubular begins to slip down, the guide plate 84 drops down from the seated position and the sensor(s) 82 automatically sends a wireless signal 98 to the control module 94. The control module 94 then automatically actuates the spider unit 90 to close upon the engaged tubular, sustaining the tubular and preventing the string 93 from dropping into the wellbore 92. Thus, this embodiment provides an additional safety measure to avoid a potentially catastrophic incident.

Although not shown in FIG. 12, it will be appreciated by those skilled in the art that embodiments of this disclosure may be implemented to suspend the tools 10 using conventional well site means (e.g., a conventional top drive on a drilling rig). Embodiments may also be implemented with the mandrel 12 having a standard box or pin type connection (11 in FIG. 1) at the upper end for coupling with a top drive, for example. It will also be appreciated that embodiments of the tool 10 may be used for land and offshore applications.

Once a tubular 58 is engaged by the tool 10 inserts 18, it can be suspended and moved to a desired location as described herein. For example, in a typical application the tool 10 will be used to engage a tubular 58 during the makeup of a tubular string 93 at a well site. An advantage of the disclosed tools 10 is the ability to quickly and easily replace the swappable inserts 18 on the slips 16 to run tubulars 58 (e.g., casing tubulars, drill collars, etc.) of different diameters without having to disassemble the mandrel 12 or disconnect the tool 10 from the rig. Another advantage provided by the disclosed tools 10 is the ability to make up the tubular 58 connections (e.g., pin-box type connections) and provide rotational torque to the determined torque specifications of the pipe manufacturer. In addition to providing rotational torque to the tubulars 58, the tool 10 embodiments also allow fluids, such as drilling mud, to be pumped into the tubulars 58 during make up of a string of drilling tubulars, for example. The fluids may be conveyed to the tool 10 via the conduit 96 or other conduits coupled to a top drive as known in the art. The mandrel 12 embodiments are configured with an internal through bore (29 in FIGS. 8A, 8B) allowing the fluids to pass through the mandrel body and out through the spear head 20. In this manner, drilling mud pressure may be maintained within a string of drilling tubulars 58 as the tubular segments are manipulated by the tool 10.

In light of the principles and example embodiments described and depicted herein, it will be recognized that the example embodiments can be modified in arrangement and detail without departing from such principles. Also, the foregoing discussion has focused on particular embodiments, but other configurations are also contemplated. It will be appreciated by those skilled in the art that embodiments may be implemented using conventional software and computer systems programmed to perform the disclosed processes and operations. It will also be appreciated by those skilled in the art that embodiments may be implemented using conventional hardware and electrical/mechanical components to provide the linkages, couplings, connections, communications, hydraulic power units, etc., in accordance with the techniques disclosed herein.

In view of the wide variety of useful permutations that may be readily derived from the example embodiments described herein, this detailed description is intended to be illustrative only, and should not be taken as limiting the scope of the invention. What is claimed as the invention, therefore, are all implementations that come within the scope of the following claims, and all equivalents to such implementations.

What is claimed is:

1. A tubular running tool, comprising:

a mandrel having an elongated body with a longitudinal axis and configured for suspension above a wellbore;

the mandrel having an upper end and a stem portion at an end opposite the upper end;

the mandrel having a plurality of stepped ramps on a surface thereof near a tip of the stem portion;

the mandrel having a plurality of superior ramps on a surface thereof near the upper end;

a plurality of slips disposed on the mandrel;

each slip having an upper end, a lower end, and a stem portion in between the ends;

each slip having a plurality of stepped ramps near the lower end of the slip, configured for complementary engagement with the plurality of stepped ramps near the tip of the mandrel stem portion;

each slip having a stepped ramp near the upper end of the slip, configured for complementary engagement with a superior ramp near the upper end of the mandrel;

each slip configured to receive and retain an insert having a gripping portion on a surface thereof;

wherein the mandrel is configured to engage the stepped ramps and superior ramps thereon with the respective stepped ramps on each slip for actuation of the slips between a neutral position and an extended position;

wherein upon actuation of the slips between the neutral position and the extended position the slips and the inserts disposed on the slips remain parallel to the longitudinal axis of the mandrel; and wherein the slips are configured for insertion within a tubular such that actuation of the slips to the extended position will urge the inserts to engage the inner surface of the tubular.

2. The tool of claim 1 wherein the mandrel is configured for rotation about the longitudinal axis of the elongated body to provide a determined torque.

3. The tool of claim 1 further comprising a hydraulic actuator configured to actuate the mandrel in an axial direction to urge the slips radially outward.

4. The tool of claim 1 further comprising a spear head coupled to one end of the mandrel.

5. The tool of claim 1 wherein each insert is configured with a circular sector profile such that an assembly of the inserts on the mandrel forms a tubular configuration having a predetermined diameter.

6. The tool of claim 1 wherein the mandrel is configured with a through bore to permit fluid flow therethrough.

7. The tool of claim 1 further comprising at least one spring surrounding the plurality of inserts to provide a constricting force on the inserts.

8. The tool of claim 1 further comprising a sensor configured to trigger actuation of the slips to the extended position to engage the tubular with the inserts when the inserts are disposed within the tubular for a full length of each insert.

9. The tool of claim 1 wherein the plurality of ramps on the surface of the mandrel are distributed from one end of the mandrel to the opposite end of the mandrel.

10. A method for running a tubular, comprising:

suspending a mandrel above a wellbore, the mandrel having an elongated body with a longitudinal axis, an upper end and a stem portion at an end opposite the upper end, a plurality of stepped ramps on a surface thereof near a tip of the stem portion, a plurality of superior ramps on a surface thereof near the upper end, and a plurality of slips disposed on the mandrel, each slip having an upper end, a lower end, and a stem portion in between the ends, a plurality of stepped ramps near the lower end of the slip configured for complementary engagement with the plurality of stepped ramps near the tip of the mandrel stem portion, each slip having a stepped ramp near the upper end of the slip configured for complementary engagement with a superior ramp near the upper end of the mandrel, and each slip configured to receive and retain an insert having a gripping portion on a surface thereof;

disposing a section of the mandrel into a tubular;

actuating the mandrel to engage the stepped ramps and superior ramps thereon with the respective stepped ramps on each slip for actuation of the slips between a neutral position and an extended position, wherein upon actuation of the slips between the neutral position and the extended position the slips and the inserts disposed thereon remain parallel to the longitudinal axis of the mandrel;

actuating the mandrel to urge the slips radially outward such that the inserts disposed on the slips are correspondingly urged radially outward to engage the inner surface of the tubular;

manipulating the tubular with the mandrel;

and actuating the mandrel at a desired location to retract the slips to disengage the inserts from an inner surface of the tubular to release the tubular.

11. The method of claim 10 further comprising mounting the inserts on the slips to establish a desired external diameter for the assembly, each insert having a pre-determined circular sector diameter.

12. The method of claim 10 wherein the mandrel is configured to torque the tubular engaged with the mandrel by rotating the tubular.

13. The method of claim 10 wherein the mandrel is configured for hydraulic actuation to actuate the mandrel in an axial direction to urge the slips radially outward.

14. The method of claim 10 wherein the mandrel comprises a spear head configured to guide the mandrel into the open end of the tubular.

15. The method of claim 10 wherein the mandrel is configured with a through bore to permit fluid flow therethrough to the bore of the tubular engaged with the mandrel.

16. The method of claim 10 wherein the inserts are configured with at least one spring surrounding the inserts to provide a constricting force.

17. The method of claim 10 wherein the plurality of ramps on the surface of the mandrel are distributed from one end of the mandrel to the opposite end of the mandrel.

18. The method of claim 10 further comprising detecting with a sensor when the inserts are disposed within the tubular for a full length of each insert to permit actuation of the slips to the extended position.

* * * * *